US005526542A

United States Patent [19]

Huang

[11] Patent Number: 5,526,542

[45] Date of Patent: Jun. 18, 1996

[54] STABLE LOWER SUPPORT OF A FOLDABLE PLAYYARD

[76] Inventor: Li-chu C. Huang, No. 9, Alley 2, Lane 606, Sec. 2, Po Ai Rd., Chiayi City, Taiwan

[21] Appl. No.: 456,063

[22] Filed: May 31, 1995

[51] Int. Cl.[6] ..... A47D 13/06

[52] U.S. Cl. ..... 5/99.1; 5/98.1

[58] Field of Search ..... 5/99.1, 98.1, 93.1

[56] References Cited

U.S. PATENT DOCUMENTS 5,243,718 9/1993 Shamie ..... 5/99.1
5,339,470 8/1994 Shamie ..... 5/99.1
5,377,368 4/1995 Cheng ..... 5/99.1
5,446,931 9/1995 Wei ..... 5/99.1

*Primary Examiner*—Alexander Grosz
*Attorney, Agent, or Firm*—Omri M. Behr

[57] ABSTRACT

A lower support of a foldable playyard having a seat assembly which is coupled between a pair of L-shaped rail sections. The seat assembly comprises a pair of sockets each having an entry opening and an inner wall adapted to securely retain a portion of a corresponding L-shaped rail section. The retention can be released by an upward lifting movement of the seat assembly causing a forced disengagement of the L-shaped rail sections from the sockets.

8 Claims, 6 Drawing Sheets

STABLE LOWER SUPPORT OF A FOLDABLE PLAYYARD

BACKGROUND OF THE INVENTION

The present invention relates to a frame assembly of a foldable playyard, and more particularly, to an improved lower support assembly of the. playyard frame assembly.

Various attempts have been made to provide a foldable playyard for safe occupation by a child. A typical foldable playyard is disclosed in U.S. Pat. No. 4,934,025 and U.S. Pat. No. 4,985,948 both to John V. Mariol. Another foldable playyard with improved frame assembly is disclosed in Applicant's German Utility Model Application G 94 14 045.6.

All the above prior designs do not specifically address the potential problem that the lower support might be inadvertently folded, such as when pushing the playyard along while it is obstructed or when the lower support is unintentionally kicked or caused to move toward a folded position. The present invention therefore is aimed to provide an improved lower support comprising means for securely retaining the lower support in position and for facilitating an easy manipulation during a folding operation of the playyard.

SUMMARY OF THE INVENTION

The present invention provides a frame assembly of a foldable playyard of the type including an upper and a lower supports and vertical rails connected between the upper and lower supports. The lower support is constructed to be retained in a stable position when the playyard is in an unfolded, working position.

The lower support further has the feature that transformation from an unfolded position to a folded position can be easily achieved by a strip affixed thereon.

The above and various other advantages and features of novelty which characterize the playyard are pointed out with particularity in the claims annexed hereto and forming a part hereof. However, for a better understanding of the invention, its advantages, and the objects obtained by its use, reference should be made to the drawings which form a part hereof, and to the accompanying descriptive matter, in which there is illustrated and described a preferred embodiment of the invention.

DESCRIPTION OF THE PREFERRED EMBODIMENTS

Figure 1:
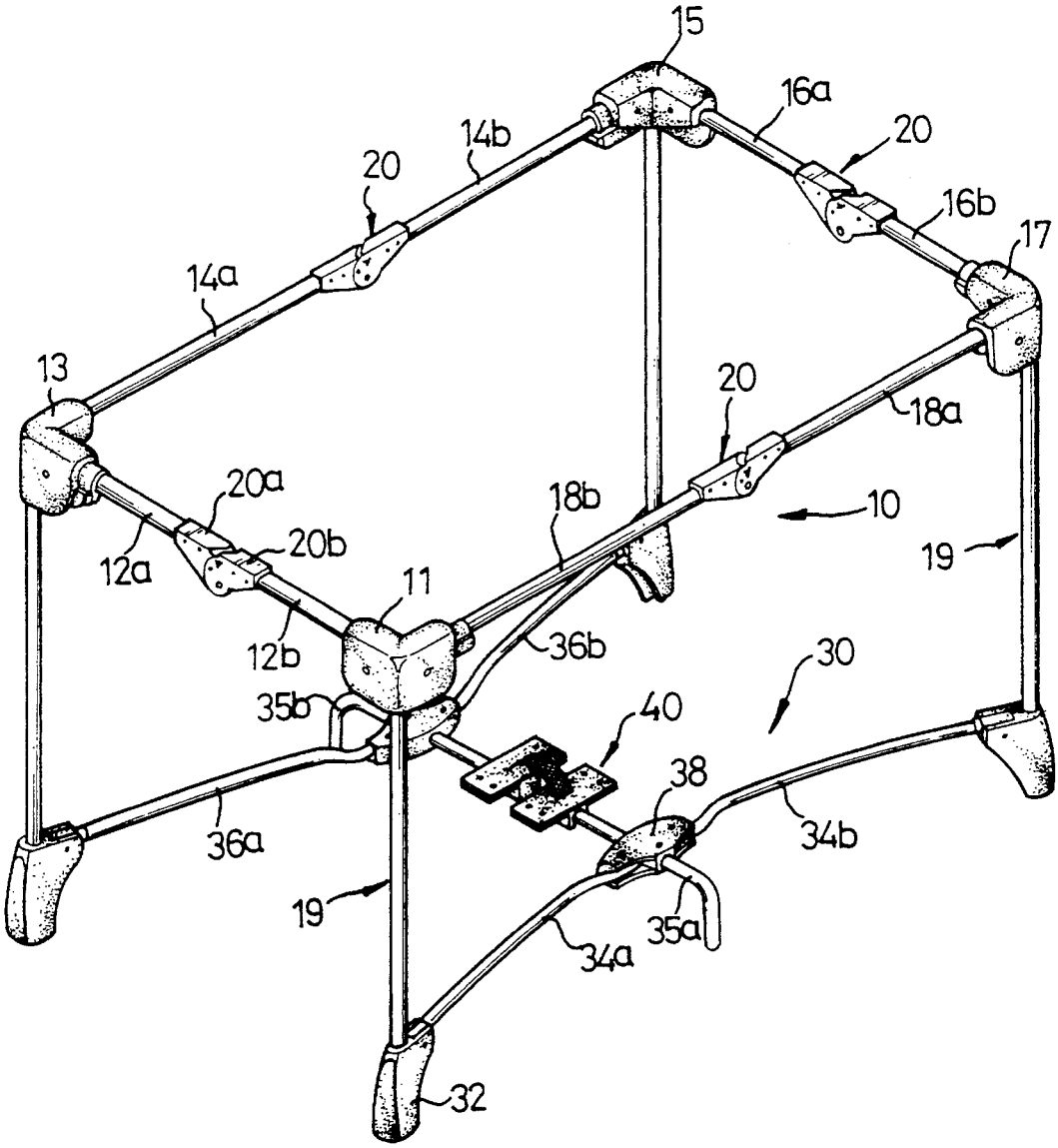
FIG. 1 is a perspective view of a foldable playyard frame assembly in accordance with the present invention.

Referring to FIG. 1, a frame assembly of a foldable playyard in accordance with the present invention comprises an upper support 10, a lower support 30 and a respective vertical rail 19 fixedly connected between the essentially rectangular upper support 10 and the lower support 30. The upper support 10 can be formed of a construction as that which is disclosed in Applicant's German Utility Model Application G 94 14 045.6 or U.S. Pat. No. 4,934,025 and U.S. Pat. No. 4,985,948 both to John V. Mariol, herein incorporated for reference.

Specifically, the upper support 10 may generally comprise four pairs of rail sections 12*a*–12*b*, 14*a*–14*b*, 16*a*–16*b* and 18*a*–18*b* and four corner brackets 11, 13, 15 and 17. Each pair of rail sections, for example the rail sections 12*a*–12*b*, is coupled to each other via a corresponding hinge 20 which is consisted of half sections 20*a* and 20*b*. Hinge half section 20*a* may include a protrusion and an arcuate notch (both not shown) for releasably engaging with an arcuate notch and a protrusion (both not shown) of hinge half section 20*b* so that the two half sections can be moved with respect to each other in only one direction but not in the other direction. In the position shown in FIG. 1, for example, the pair of rail sections 12*a*–12*b* can so pivot about the hinge 20 that only an upward movement of the hinge 20 is permitted. In this case, in order to fold the upper support, there is provided between each rail section and a corresponding corner bracket means which permits each pair of rail sections to rotate about its own longitudinal axis in advance so that the hinges can be moved in a downward direction instead. Alternatively, the connection or securement between each rail section (e.g. section 12*a*) and the associated corner bracket (e.g. corner bracket 13) may be simply by pivot pin (not shown) which allows the rail section to move from its assembled horizontal position to its collapsed downwardly extending vertical position. As indicated previously, the upper support and its folding movement or operation are basically of a known construction so that a detailed description is deemed not necessary.

The following will therefore concentrate on the lower support 30 of the invention.

Figure 2:
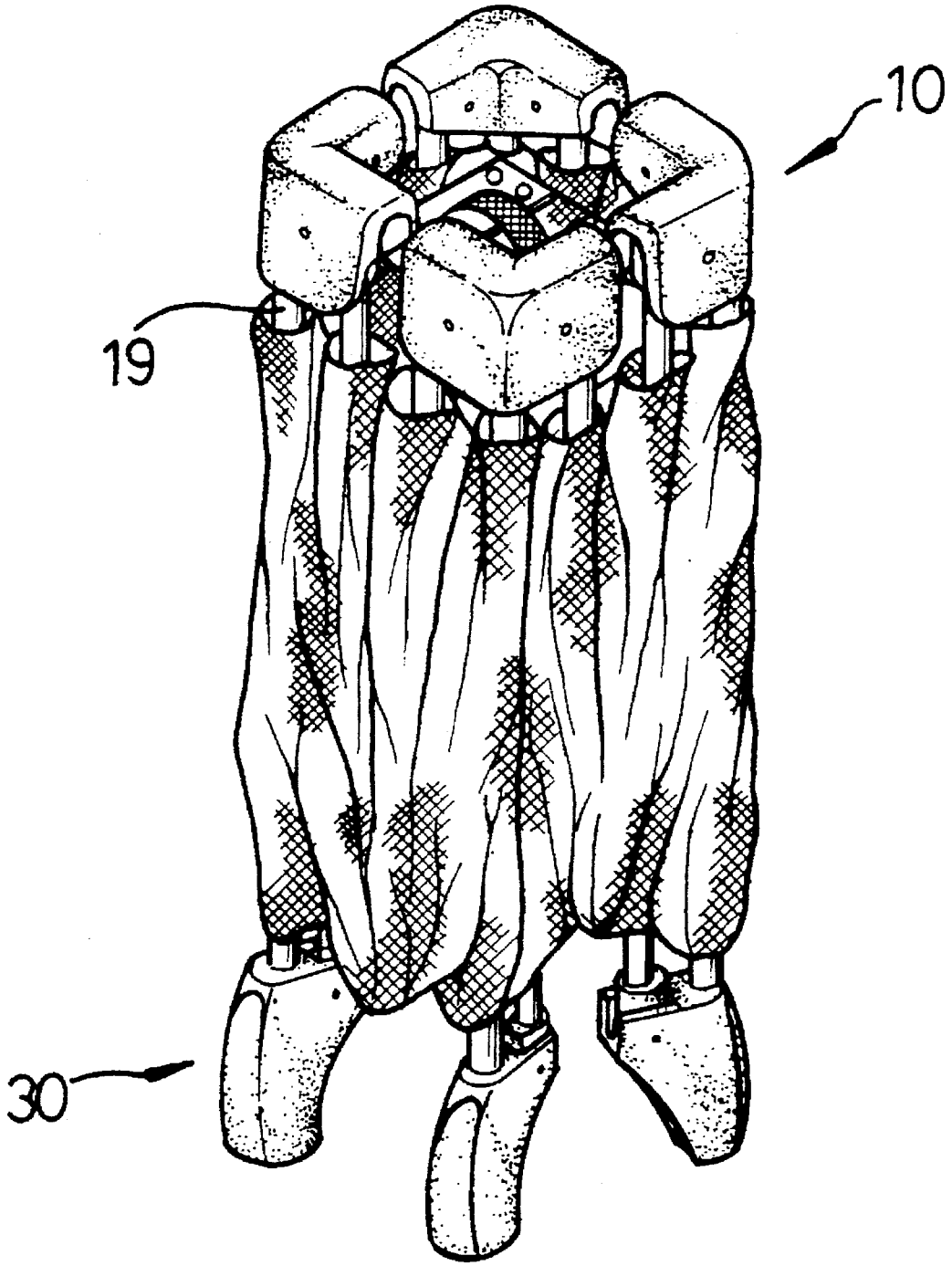
FIG. 2 shows the playyard frame assembly in a folded condition with a fabric assembly used thereon also being shown.

As seen in FIG. 1, the lower support 30 comprises four legs 32 each for receiving a corresponding vertical rail 19, two pairs of curved rail sections 34*a*–34*b* and 36*a*–36*b* each coupled between two adjacent legs 32, a pair of L-shaped rail sections 35*a*–35*b*, a pair of wing pieces 38 each receiving a corresponding L-shaped rail section 35*a* or 35*b* and coupling a corresponding pair of curved rail sections 34*a*–34*b* or 36*a*–36*b*, and a seat assembly 40 coupled between the pair of L-shaped rail sections 35*a* and 35*b*. FIG. 2 shows the playyard frame assembly in a folded condition for storage with a fabric assembly provided thereon as is conventional in this art.

Figure 3:
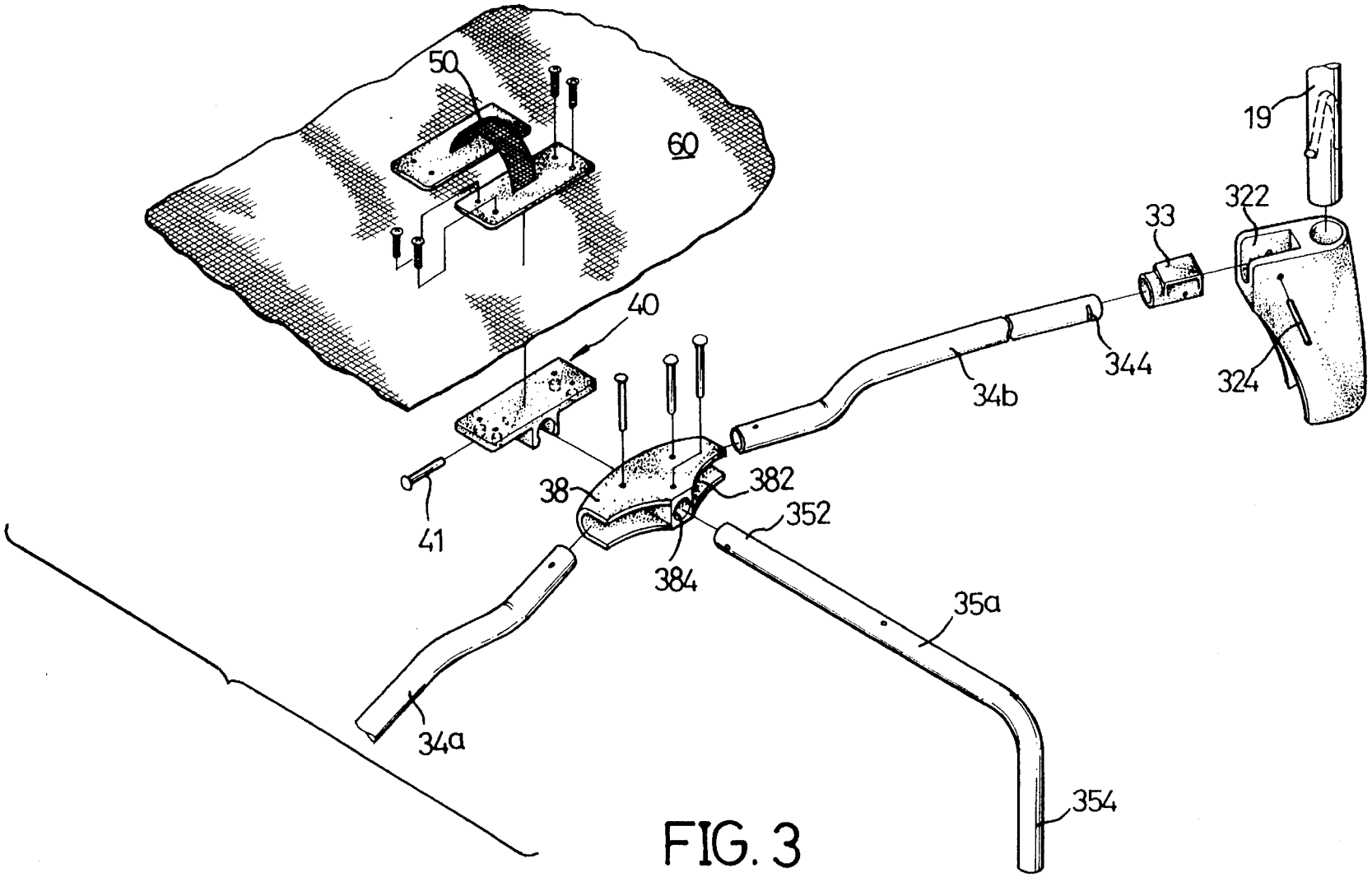
FIG. 3 is a partial exploded view showing certain components of a lower support of the foldable playyard.
Figure 4:
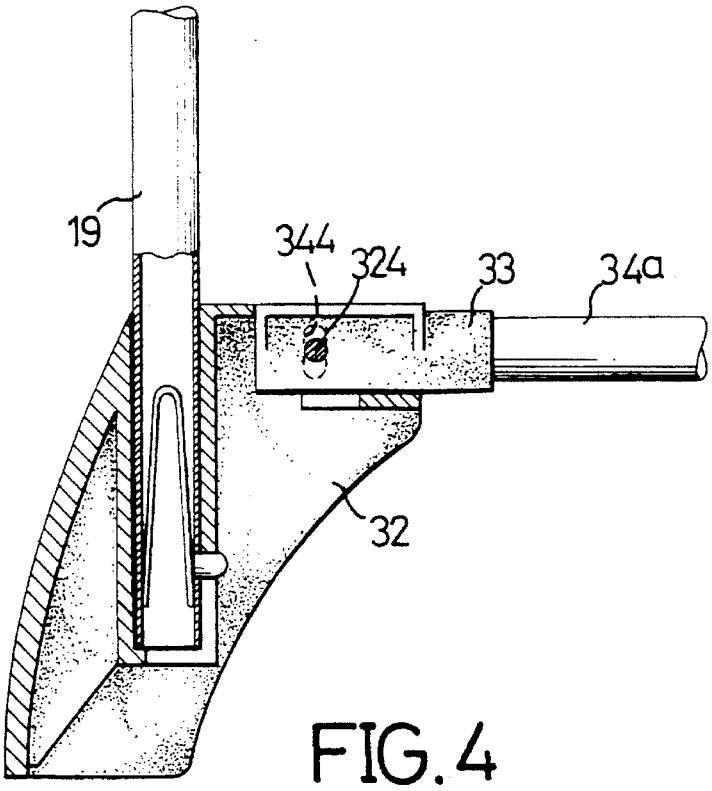
FIG. 4 is a partial cross-sectional view of a portion of the lower support in an unfolded position.
Figure 5:
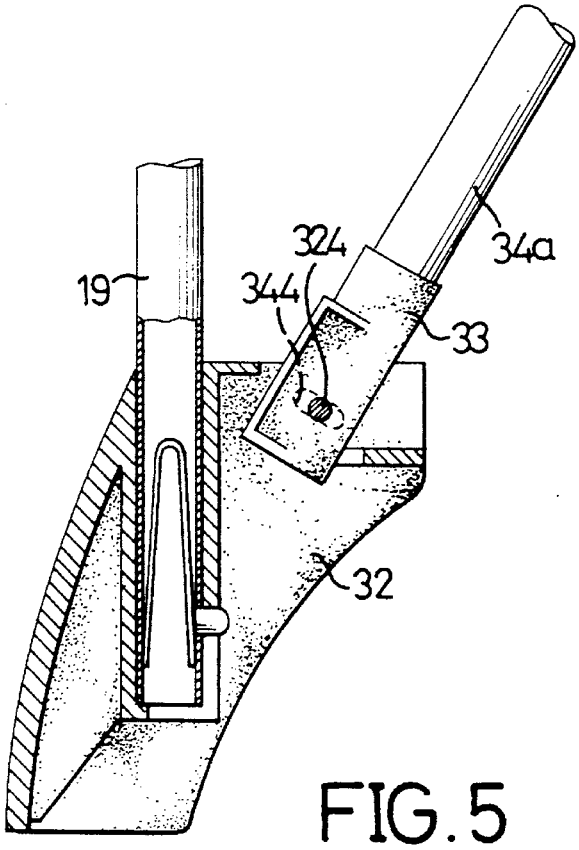
FIG. 5 is a view similar to FIG. 4 but showing the portion of the lower support in a folded position.

Referring to FIGS. 3, 4 and 5, the construction and operation of the lower support 30 will now be detailed.

The wing piece 38 has a side recess 382 at either side thereof and a central through-hole 384. Each side recess 382 receives one end of a respective curved rail section 34*a* or 34*b* which in turn is pivotally connected by a pin connection to the wing piece 38 so that the curved rail section is pivotable within the recess. Another end of the curved rail section 34*a* or 34*b* is connected to a seat 33 forming part of the leg 32. The seat 33 is received in a compartment 322 of the leg 32 in a pivotal manner by a pin 324 passing through the leg 32 and the seat 33 within the compartment 322.

FIGS. 4 and 5 show, respectively, the two positions assumed by the curved rail section 34*a* by way of the pivotal seat 33. In order that the wing piece 38 and therefore the curved rail section 34*b* can effectuate a turning movement during a folding operation of the lower frame 30, an elongate slot 344 is formed on the curved rail section 34*b*. The angular length of the slot 344 is sufficiently large to accommodate the turning movement of the curved rail sections 34*a* and 34*b* about individual pins 324. Said turning movement is necessary because after a folding operation the wing piece 38 will rotate a certain angle about a general longitudinal axis of the curved rail section 34*b* with respect to the orientation of the leg 32 to achieve the storage position of FIG. 2. The L-shaped rail section 35*a* or 35*b* extends through the through-hole 384 and is then fixed in position with one free end 352 thereof to be coupled to the seat assembly 40. Another free end 354 of the L-shaped rail section 35*a* contacts the ground when the playyard is in use.

Figure 6:
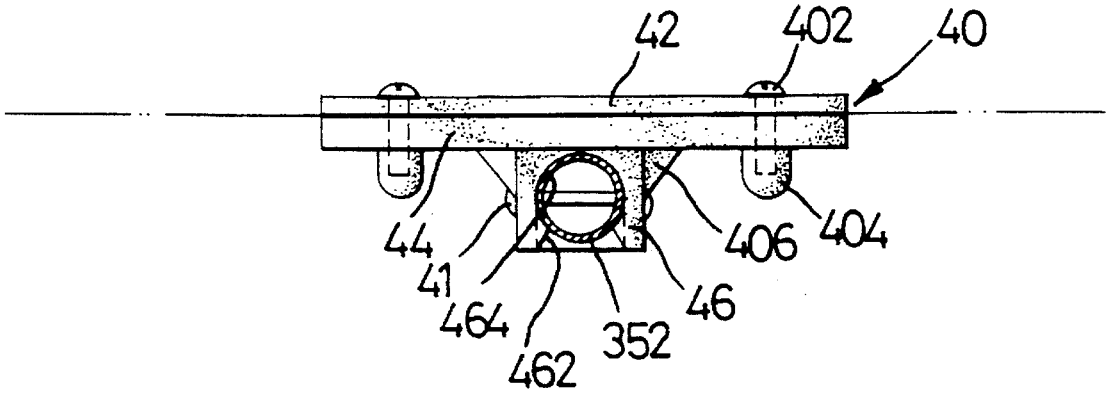
FIG. 6 is a front view showing a seat assembly coupled with an L-shaped rail section, the latter being shown in cross-section.
Figure 7:
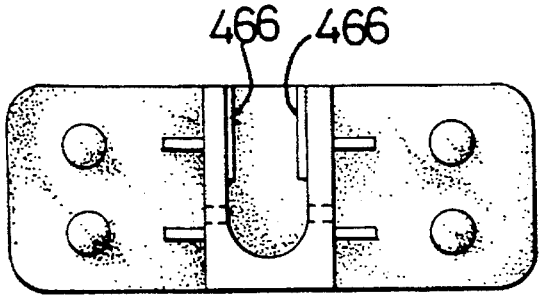
FIG. 7 is a bottom view of the seat assembly with the L-shaped rail section being removed.

As mentioned above, the function of the seat assembly 40 is to couple the end 352 of the L-shaped rail section 35*a*. FIGS. 6 and 7 more specifically show the seat assembly 40. As seen in FIG. 6, the seat assembly 40 consists of a pair of identical sub-assemblies each comprising an upper plate 42 and a lower plate 44 fixedly secured to the upper plate for example by means of screw 402 and nut 404. Alternatively, the upper plate 42 of individual sub-assembly can be connected to be a single unit instead of being separate ones. A fabric or flexible enclosure 60 can then be interposed and retained between the upper and lower plates (cf. FIGS. 3 and 6). The lower plate 44 has a respective socket 46 of a resilient material and integral reinforcing ribs 406. The socket 46 has an entry opening 462 permitting a forced entry of the end 352 of the L-shaped rail section 35*a* and a substantially cylindrical inner contour 464 for containing the end 352 in position. A pin 41 then passes through the socket 46 and the end 352 so that the L-shaped rail section 35*a* can perform a pivotal movement about the end 352 with respect to the socket 46 of the seat assembly 40.

The inner contour or wall terminates as two protrusions 466 defining the entry opening 462. The protrusions 466 confine the end 352 within the inner wall when the frame assembly is in the position of FIG. 1, while permitting a forced disengagement when desired.

Figure 8:
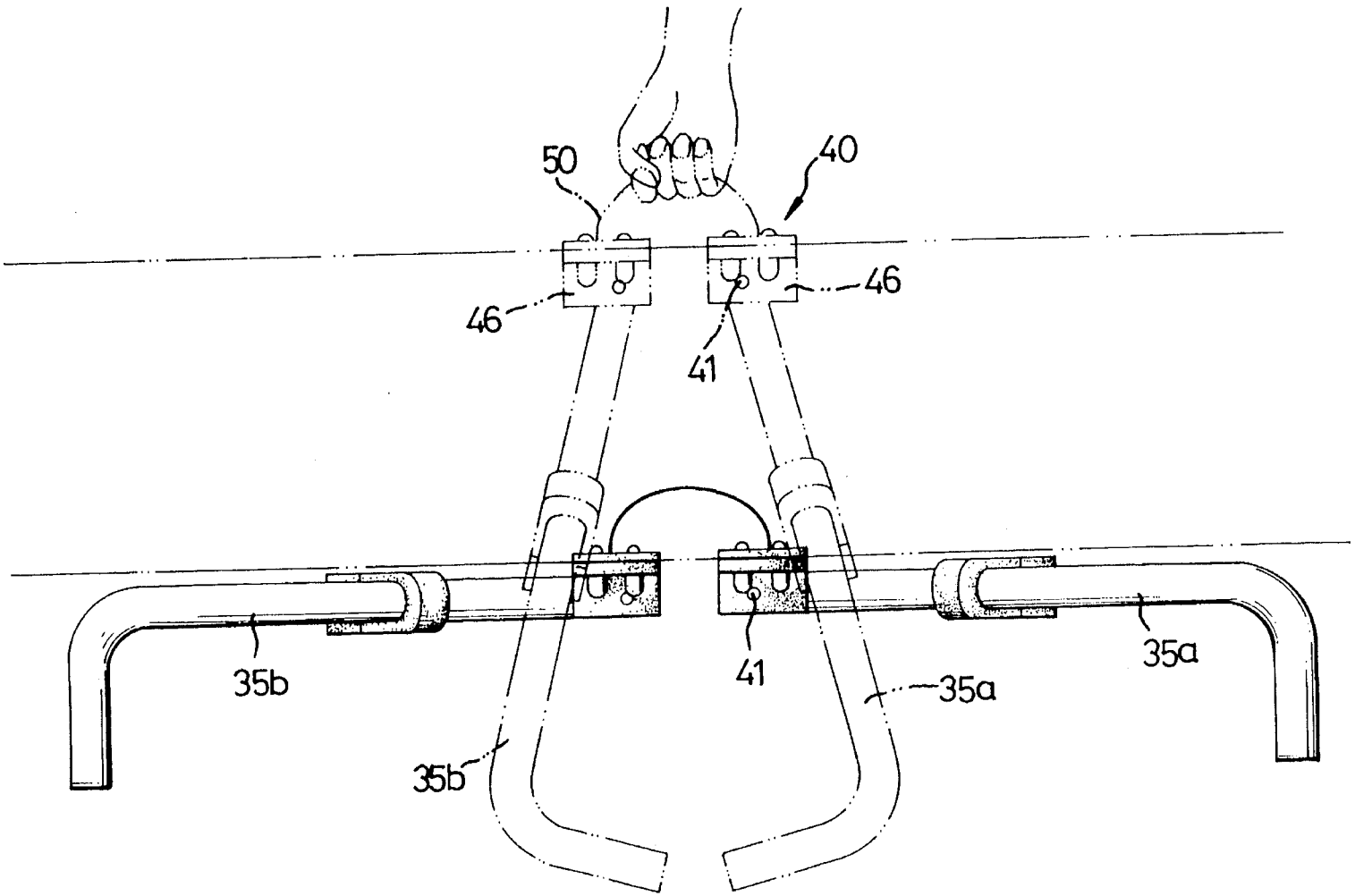
FIG. 8 is schematic view showing a strip on the seat assembly being manipulated by a user's hand to lift upward.

FIG. 8 shows that the seat assembly 40 is lifted from the position represented by solid lines to the position represented by dotted lines, causing the pair of L-shaped rail sections 35*a*–35*b* to pivot about the pin 41 to disengage from the retention of the sockets 46. Moreover, a strip 50 can be advantageously provided on the seat assembly 40. The strip 50 is fastened on the upper plate 42 and can be conveniently gripped by fingers of a user to apply an upward force to lift the seat assembly 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. In a foldable playyard including an essentially rectangular upper support composed of four pairs of hingedly coupled rail sections with each pair further pivotably connected to a respective corner bracket provided at four corners of the upper support, a lower support and four vertical rails fixedly connected between the corner bracket and the lower support, the improvement wherein the lower support comprises four legs each for receiving a corresponding vertical rail, two pairs of curved rail sections each coupled between two adjacent legs, a pair of L-shaped rail sections, a pair of wing pieces each receiving a corresponding L-shaped rail section and coupling a corresponding pair of curved rail sections, and a seat assembly coupled between the pair of L-shaped rail sections, each curved rail section being pivotally rotatably coupled at one end thereof to the leg and being pivotably coupled at the other end thereof to the wing piece, and the seat assembly pivotably receiving each L-shaped rail section and having means for releasably locking the pair of L-shaped rail sections in position.

2. The improvement as claimed in claim 1, wherein the means for releasably locking comprises a pair of sockets each having an entry opening and an inner contour adapted to securely retain a portion of a corresponding L-shaped rail section.

3. The improvement as claimed in claim 2, wherein each L-shaped rail section and the inner contour of each socket both have a substantially cylindrical shaped cross-section.

4. The improvement as claimed in claim 2, further comprising a strip affixed to a top of the seat assembly for facilitating an upward movement of the seat assembly.

5. A foldable playyard comprising:

an essentially rectangular upper support composed of four pairs of rail sections each centrally coupled by a hinge, each pair of rail sections being pivotably connected to a respective corner brackets provided at four corners of the upper support to form a foldable upper support, four vertical rails each fixedly connected to a corresponding corner bracket, a lower support comprising:

four legs each for receiving a corresponding vertical rail, two pair of curved rail sections each coupled between two adjacent legs, a pair of L-shaped rail sections, a pair of wing pieces each receiving a corresponding L-shaped rail section and coupling a corresponding pair of curved rail sections, and a seat assembly being pivotably connected with the pair of L-shaped rail sections, each curved rail section being pivotally rotatably coupled at one end thereof to the leg and being pivotably coupled at the other end thereof to the wing piece, and the seat assembly having means for lockingly receiving the pair of L-shaped rail sections in position and being liftable to disengage from the pair of L-shaped rail sections.

6. The playyard as claimed in claim 5, wherein the means for lockingly receiving comprises a pair of sockets each having an entry opening and an inner contour adapted to securely retain a portion of a corresponding L-shaped rail section.

7. The playyard as claimed in claim 6, wherein each L-shaped rail section and the inner contour of each socket both have a substantially cylindrical shaped cross-section.

8. The improvement as claimed in claim 6, further comprising a strip affixed to a top of the seat assembly for facilitating an upward movement of the seat assembly.

* * * * *